United States Patent [19]

Bergeson

[11] 4,227,546

[45] Oct. 14, 1980

[54] DISHWASHER FLUID CONTROL SYSTEM

[75] Inventor: Richard P. Bergeson, Newton, Iowa

[73] Assignee: The Maytag Company, Newton, Iowa

[21] Appl. No.: 939,994

[22] Filed: Sep. 6, 1978

[51] Int. Cl.[3] ..... F16K 21/18

[52] U.S. Cl. ..... 137/387; 134/58 D

[58] Field of Search ..... 137/387; 134/57 D, 58 D; 68/207

[56] References Cited

U.S. PATENT DOCUMENTS

| | | | |
|---|---|---|---|
| 2,477,415 | 7/1949 | Oliver | 137/387 |
| 2,934,928 | 5/1960 | Shelton | 68/207 |
| 3,065,618 | 11/1962 | Cobb et al. | 137/387 |
| 3,095,895 | 7/1963 | Jacobs | 137/387 |
| 3,133,433 | 5/1964 | Gebel | 137/387 |
| 3,292,645 | 12/1966 | Braden et al. | 134/57 D |
| 3,362,197 | 1/1968 | Reed | 137/387 |
| 3,451,400 | 6/1969 | Cushing | 134/58 D |
| 3,465,762 | 9/1969 | Guth | 134/58 D |
| 3,702,680 | 9/1969 | Guth | 239/256 |
| 3,835,880 | 9/1974 | Hoffman | 137/387 |
| 4,004,600 | 1/1977 | Corn et al. | 134/57 D |
| 4,119,116 | 10/1978 | Johnson et al. | 137/387 |

*Primary Examiner*—Martin P. Schwadron
*Assistant Examiner*—G. L. Walton
*Attorney, Agent, or Firm*—Richard L. Ward

[57] ABSTRACT

A dishwashing apparatus having a pump arrangement which is belt driven by a laterally disposed drive motor. The apparatus further includes a tub defining a washing chamber and a fluid inlet system including a fill valve for supplying fluid to the washing chamber. The pump recirculates the fluid within the washing chamber to wash the dishes and drains the fluid from the washing chamber. A timer controls the apparatus through a predetermined cycle of recirculation and drain periods for rinsing and washing the dishes. Operation of the fill valve is controlled to provide different levels of fluid for rinsing and washing with the fill valve being operable prior to recirculation in predetermined fills to provide a first fluid level and being operable after recirculation has begun in at least one other fill to provide a second higher fluid level.

8 Claims, 4 Drawing Figures

DISHWASHER FLUID CONTROL SYSTEM

BACKGROUND OF THE INVENTION

1. Field of the Invention

This invention relates generally to dishwashers and more particularly to a fluid inlet control system therefor.

2. Description of the Prior Art

Several prior art patents indicate the desirability of providing variable fluid levels. These prior art patents, however, generally use a low fluid level to partially starve the pump and thereby provide either a gentle washing action or distribute washing fluid to only part of the washing chamber.

Guth U.S. Pat. Nos. 3,465,762 and Corn et al 4,004,600 both provide for different levels of fill. A first level is provided for priming the first of two pumps and a second level is provided for priming both pumps. Priming the first pump produces a washing action from only one wash arm while priming both pumps produces washing action from both upper and lower wash arms.

Hoffman et al in U.S. Pat. No. 3,835,880 provides a dishwasher fill system which operates over a wide range of water supply pressures. The timer runs continuously and controls a fill valve in series with a pressure switch. If the water pressure is so low that the machine does not fill to a predetermined level in the time increment allotted, the timer will initiate a recirculation operation and continue to advance through the cycle. With normal water pressure, the pressure switch will shut off the water supply before the allotted time increment is completed.

SUMMARY OF THE INVENTION

It is an object of the instant invention to provide an improved dishwasher construction.

It is a further object of the instant invention to provide a fill system for supplying a predetermined amount of washing fluid to prevent starvation and to insure satisfactory performance of the recirculation pump.

It is a still further object of the instant invention to provide for a first level of fluid in predetermined portions of the cycle and a second level of fluid in at least one other predetermined portion of the same cycle.

The instant invention achieves these objects in a dishwashing apparatus including a washing chamber. A fluid inlet system is provided for supplying fluid to the washing chamber and a pump recirculates the fluid within the washing chamber. A sequential controller controls the apparatus during a cycle of operations including a plurality of fluid recirculation periods. Apparatus is provided for controlling the fluid inlet system to admit a first quantity of fluid into the washing chamber prior to each of the fluid recirculation periods of the cycle of operations and to admit an additional quantity of fluid during at least one of the fluid recirculation periods of the same cycle of operations.

Operation of the device and further objects and advantages thereof will become evident as the description proceeds and from an examination of the accompanying three pages of drawings.

BRIEF DESCRIPTION OF THE DRAWINGS

The drawings illustrate a preferred embodiment of the invention with similar numerals referring to similar parts throughout the several views, wherein.

DESCRIPTION OF A PREFERRED EMBODIMENT

Figure 1:
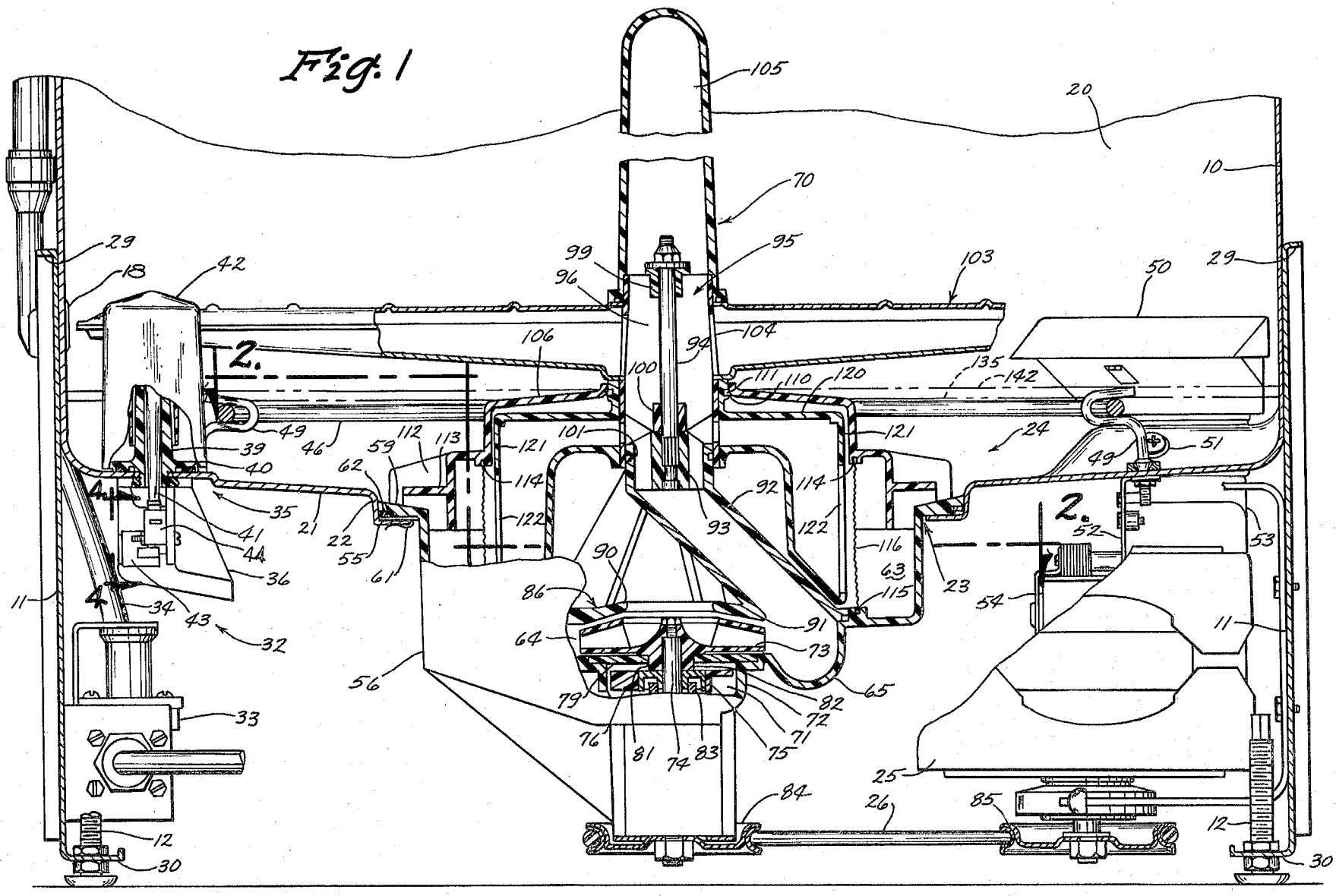
FIG. 1 is a cross section view of the dishwasher comprising, primarily, a vertical section of the combination sump and pump construction and also including the fluid inlet system.
Figures 2, 4:
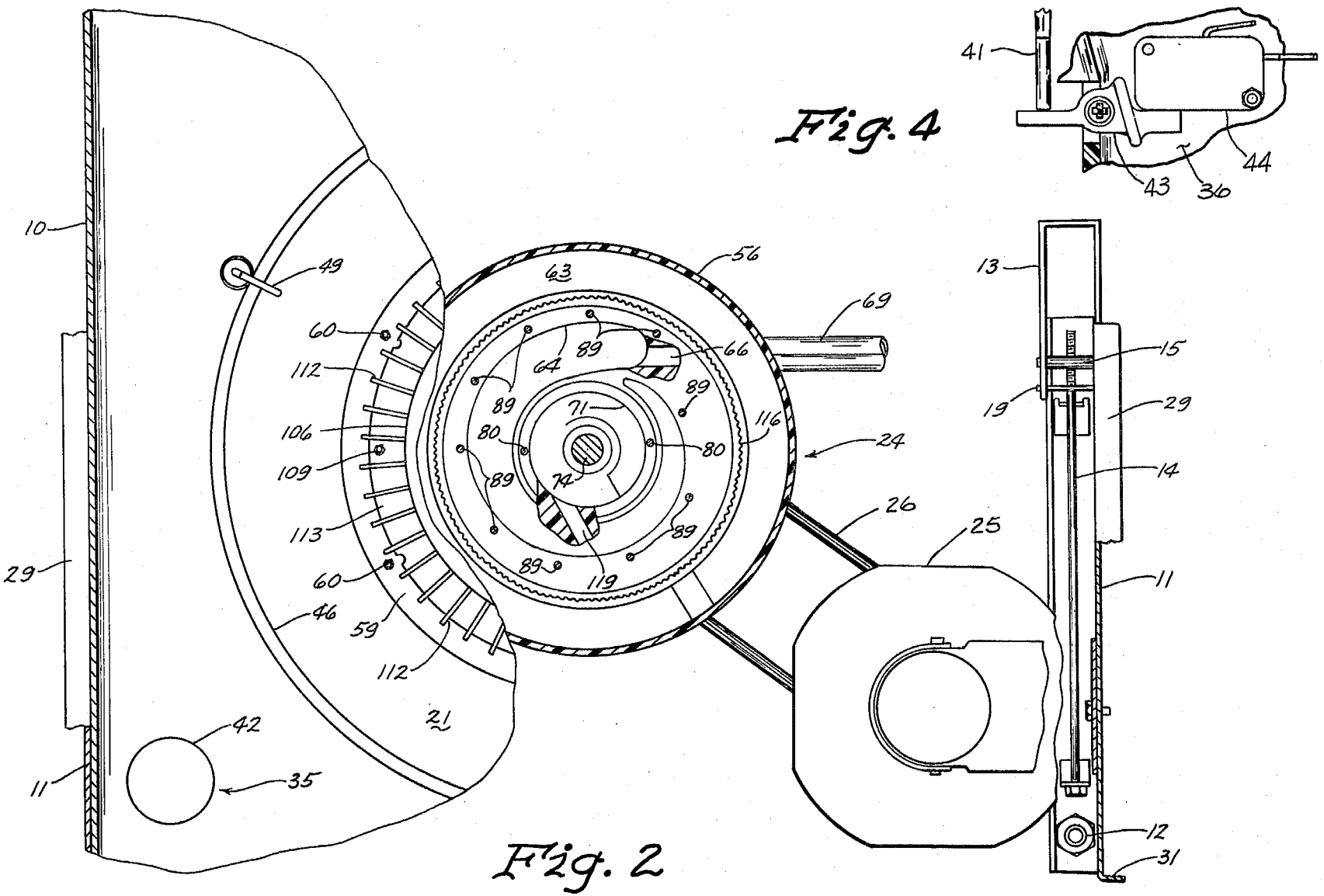
FIG. 2 is a fragmentary plan view of the dishwasher apparatus of FIG. 1 as partially sectioned and taken generally along lines 2—2 of FIG. 1.
FIG. 4 is a partial fragmentary section view taken generally along lines 4—4 of FIG. 1.

Referring to the drawings there is shown in FIGS. 1 and 2 a dishwasher. The dishwasher includes a tub or fluid container 10 of which only a lower portion is shown and to which is attached a pair of side supports 11 extending downwardly toward floor engaging members. The dishwasher is supported on a plurality of these floor engaging members including a pair of screw-in feet 12 at the front of the dishwasher which are easily adjustable from the front of the dishwasher and also including a pair of pivotally mounted feet 13 at the rear of the side supports 11. The pivoted feet 13 are also adjustable from the front of the dishwasher through a pair of hex headed elongated members 14 extending, as in FIG. 2, from the front of the dishwasher to the rear of the dishwasher into threaded engagement with a pivot bar 15 for moving the floor engaging foot 13 about a pivot pin 19 as more particularly disclosed and claimed in U.S. Pat. No. 3,750,989 issued Aug. 7, 1973 to Richard P. Bergeson and assigned to the assignee of the instant invention.

The fluid container or tub 10 defines, as best shown in FIG. 1, a chamber 20 having a bottom wall 21 which defines a generally central recess 22 and opening 23 in which is positioned a combination sump and pump assembly 24 including a recirculating pump operable for effecting a recirculation of fluid to the washing chamber 20 and a drain pump for removing washing fluid from the chamber 20, as will be described in detail hereinafter. As shown in FIG. 1, the pumps are connected to the laterally disposed drive motor 25 by a stretch belt 26.

In FIG. 1, there is shown a generally vertical cross section of the lower portion of the washing chamber 20 and the combination sump and pump assembly 24. As previously indicated, the tub 10 is supported by a pair of side legs or supports 11 having reinforcing flanges 29 and 30 extending along a slanting top and along the bottom respectively, as best seen in FIG. 1 and flanged along the front at 31 as best seen in FIG. 2. The bottom flanges 30 provide means for receiving the floor engaging members, such as the two screw-in feet 12 positioned at the front of the dishwasher. These feet 12 may be adjusted to vary the height of the dishwasher within the provided cabinet opening.

FIG. 1 also shows a portion of the fluid inlet system 32 including an electrically operated fill valve 33 mounted on the side support 11. The conduit 34 from the fill valve 33 extends toward the rear of the dishwasher and upwardly along the side of the tub 10 and connects with the sidewall of the tub 10 at inlet 18 for directing washing fluid into the washing chamber 20. The inlet system 32 along the sidewall of the tub 10 includes the necessary air gap.

A float device 35, as shown in FIG. 1 and partially in FIG. 2, is provided for use as a fluid level detecting device in the washing chamber 20. As shown in FIG. 1, a switch mounting base plate 36 is secured to the outside of the bottom wall 21 of the tub 10. A standpipe 39 which extends into the tub 10 a distance substantially greater than the permitted fluid level is threaded into that portion of the base plate 36 which contacts the tub bottom wall 21. A gasket 40, as shown in FIG. 1, prevents leaks between the standpipe 39 and the base plate 36. The stem 41 of the float 42 extends downwardly within the standpipe 39 and rests on one end of a centrally pivoted actuator lever 43 as shown in FIG. 4. The opposite end of the actuator lever 43 engages with the actuator button of an electrical switch 44 mounted on the side of the base plate 36 and the weight of the float 42 is utilized to maintain the electrical switch 44 in a closed or conducting posture. As shown diagramatically in FIG. 3, the electrical switch 44 is connected in series with the dual solenoid coils of the fill valve 33 and contacts 182 and 185 of the timer or sequential controller 45 (shown diagrammatically in FIG. 3) and is operable from the closed or conducting posture to an open or non-conducting posture to open the fill valve 33 circuit when the float 42 rises after a first predetermined quantity of fluid has been admitted into the washing chamber 20.

A heater 46, as shown in FIGS. 1 and 2, is provided within the washing chamber 20 for raising the temperature therein and includes an elongated arcuate element supported by a plurality of supports 49 attached to the fluid container bottom wall 21.

Figure 3:
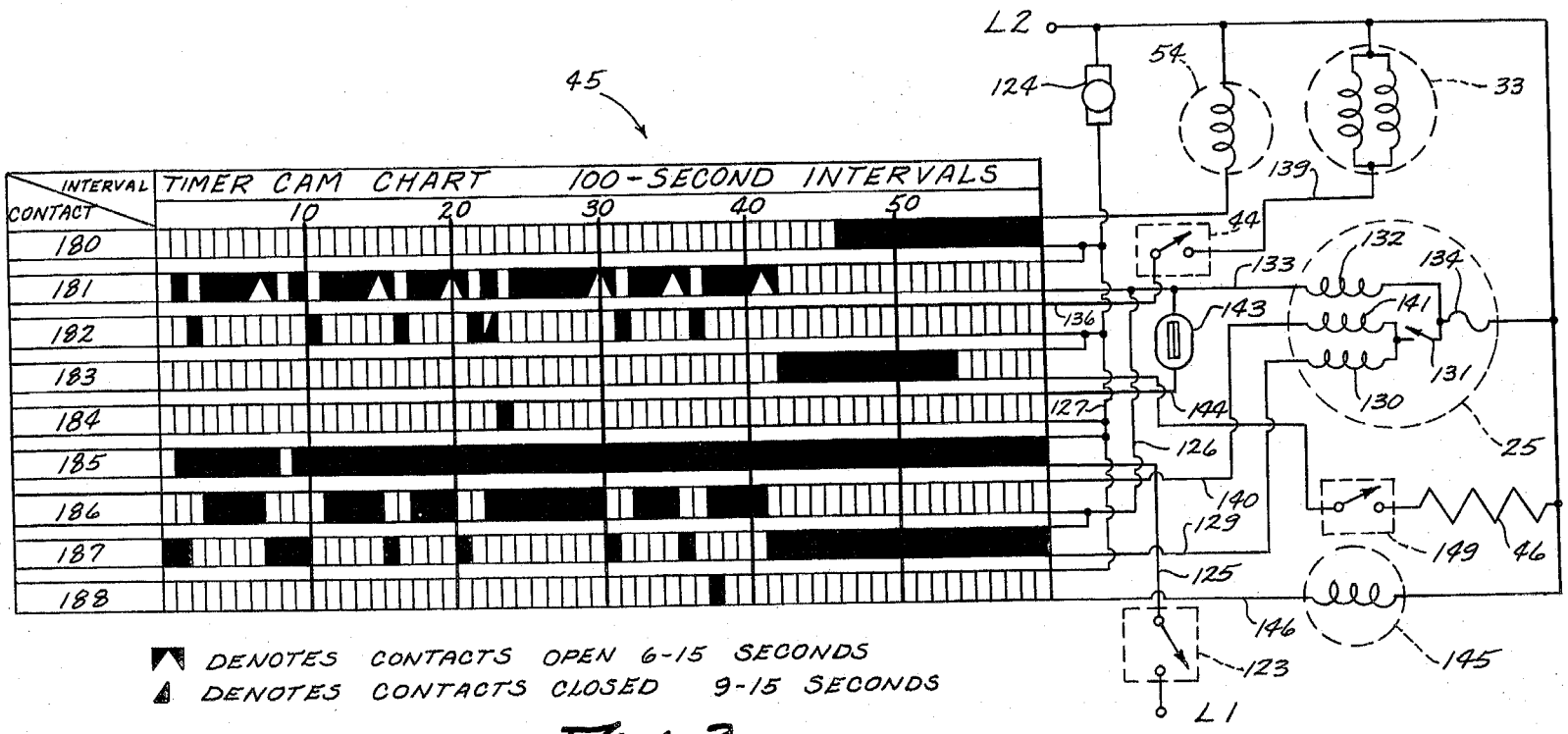
FIG. 3 is a timer cam chart and electrical schematic circuit for the dishwasher apparatus.

The heater 46 and the blower motor 54, shown in FIG. 1 and schematically in FIG. 3, are included in a blower system. The blower system further includes an air distribution inlet and vent cap 50 which enters the washing chamber 20 in the lower right rear corner of the tub 10. The vent cap 50 is constructed so as to distribute ambient temperature incoming air over the heater 46 and upwardly through the dishes. Secured to the bottom wall 21 of the tub 10 by the fastener 51 is a blower bracket 52 and housing 53 which mount the blower motor 54 and blower wheel (not shown) for forcing ambient temperature air into the tub 10.

As previously indicated, the bottom wall 21 includes a generally centrally located recess 22 having a flange 55 defining an opening 23 for receiving the combination sump and pump assembly 24. The main sump-pump housing 56 is generally annular and is assembled into the opening 23 in the bottom wall 21 from inside the washing chamber 20 so that the upper flange 59 of the housing 56 engages the recessed flange 55 of the bottom wall 21. The flange 59 is connected to the bottom wall 21 recessed flange 55 by a plurality of threaded members 60, such as in FIG. 2 and retainer clips 61, as in FIG. 1. An annular seal 62 is disposed at the joint to prevent fluid leakage from the washing chamber 20.

A first portion of the housing 56 depending from the bottom wall 21 defines a generally annular sump 63 facing generally upwardly toward the washing chamber 20 as best shown in FIGS. 1 and 2. Disposed generally below the sump 63 is a recirculation pump cavity 64 defined by a second housing portion 65 and having a volute form for receiving fluid from the sump 63 and through which the fluid is pumped to the fluid distribution system for effecting washing of articles in the washing chamber 20.

Referring to FIG. 2, inner portions of the sump and pump assembly 24 including the recirculation pump cavity 64 are shown by removing a number of components of the assembly. Also referring to FIG. 2, there is shown an outlet 66 extending from the end of the recirculation pump cavity 64 for connection with the upwardly extending conduit 69 which carries a portion of the fluid from the recirculation pump cavity 64 to an upper spray arm (not shown). The recirculation pump cavity 64 is also connected to the lower fluid distribution system 70 as shown in FIG. 1 as will be more fully explained hereinafter.

Disposed below the recirculation pump cavity 64 is a radially smaller and generally annular drain pump cavity 71 defined by a third housing portion 72 for accommodating flow of fluids from the dishwasher sump 63 to an external drain.

A closed vane recirculation impeller 73 is mounted on the shaft 74 for operation within the recirculation pump cavity 64. A drain pump impeller 75 is also mounted on the shaft 74 and is disposed within the drain pump cavity 71 and includes a plurality of downwardly extending open vanes 76.

A divider 79 is disposed below the recirculation pump impeller 73 to effectively divide the recirculation and drain pump cavities 64 and 71. The divider 79 is fixed to the housing 56 by a pair of screws 80, as in FIG. 2, and includes an inner lip 81 juxtaposed to the hub 82 of the recirculation impeller 73. Disposed below the drain pump impeller 75 is a fluid seal arrangement 83 including a fluid slinger (not shown) to prevent fluid from entering the bearings (not shown). A pulley 84 is secured to the lower end of the pump shaft 74 to effect rotation of the pump shaft 74 and the pair of impellers 73 and 75.

The pump pulley 84 is connected to the motor pulley 85 by a round polyurethane drive belt 26. The motor 25 is operable in first and second directions for driving the pump shaft 74 to effect, in one direction of rotation, a recirculation of fluid to the washing chamber 20 and to effect, in the opposite direction, a draining of fluid from the washing chamber 20 and sump 63.

An intermediate or internal housing 86 is disposed within the sump 63 as in FIG. 1. The intermediate housing 86 has been removed from the assembly in FIG. 2 but is attached to the main housing 56 by a plurality of screws 89 along the recirculation pump cavity 64 as shown in FIG. 2. The intermediate housing 86 comprises a cover 90 for the recirculation pump and defines an axial inlet into the recirculation pump cavity 64. The intermediate housing 86 also defines an outlet 91 from the recirculation pump at the end of the volute cavity and forms an upwardly extending conduit or tube 92 from the outlet 91 for connection with the fluid distribution system 70 disposed in the lower portion of washing chamber 20. The upper end of the conduit or tube 92 includes an internal hub 93 for fixedly supporting a shaft 94 on which a spray device is mounted and as will be described hereinbelow.

The lower fluid distribution system 70 includes an upstanding fluid conduit or fluid distribution hub 95 having a plurality of internal ribs 96 supporting a pair of bearings 99 and 100 for rotational support of the hub 95 on the shaft 94. The lower end of the conduit or hub 95 engages a seal 101 disposed in a groove of the upper portion of the upwardly extending tube 92 and interlocked with the tube 92 to prevent rotation of the seal 101. The main spray arm 103 is mounted on the upstanding fluid distribution conduit or hub 95 for rotation therewith. Openings 104 in opposite sides of the fluid distribution conduit or hub 95 at the spray arm 103 accommodate the fluid flow from the recirculation pump cavity 64 to the outwardly extending spray arm 103. A nozzle 105 extends upwardly from the end of the fluid distribution conduit or hub 95 for distributing washing fluid up into the intermediate regions of washing chamber 20. The nozzle 105 is fixed to the end of the fluid distribution conduit or hub 95 for rotation therewith and for retaining the spray arm 103 on the conduit or hub 95.

An upper housing portion or cover 106 is attached to the main housing 56 along the upper flange 59 of the main housing at screws 109 as in FIG. 2. The cover 106 is substantially imperforate and includes a generally central opening 110 for accommodating the upwardly extending fluid distribution conduit 95. A seal 111 is disposed at the opening 110. Along the periphery of the cover 106 as best shown in FIGS. 1 and 2 are a plurality of generally upstanding radiating ribs 112 that extend radially beyond the outer horizontal flange 113 of the cover 106. The outer periphery of the cover 106 thus defines a strainer between the washing chamber 20 and the sump 63 to prevent flow of large particles from the washing chamber 20 into the sump 63.

A lower surface of the cover 106 defines a downwardly facing annular groove 114 generally aligned with a similarly upwardly facing annular groove 115 in the lower portion of the sump 63. These grooves 114 and 115 receive the end rings of a generally annular and cylindrical fine mesh filter screen 116 for support within the sump 63. The filter screen 116 thus effectively divides the sump 63 into first and second portions with the inlet of the conduit to the drain pump cavity 71 being outside or upstream from the filter 116, while the inlet to the recirculation pump cavity 64 is radially within or downstream relative to the filter 116.

The disposition of the filter 116 within the sump 63 between the inlets of the drain and recirculation pumps effectively establishes two fluid paths from the washing chamber 20. A first fluid path extends from the washing chamber 20 through the strainer, the outer sump portion, and the filter screen 116 into the inner sump portion for conduction to the inlet of the recirculation pump. The fluid is then pumped to the fluid distribution means. A second fluid path extends from the washing chamber 20 through the strainer to the outer sump portion and from the outer sump portion through the housing-defined fluid duct to the inlet of the drain pump cavity 71. From the drain pump cavity 71 the fluid is pumped to an external drain through the drain pump outlet 119 when the pump is driven in the drain direction.

Disposed within the annular filter screen 116 is an auxiliary spray device for effecting a cleaning or back flushing of the filter screen 116. The device includes an arm 120 comprising two depending spray tubes 121 having an elongated slit 122 along the surface adjacent to the screen 116 for spraying fluid onto the downstream side of the screen 116. The arm 120 is fixed to and rotatable with the upstanding fluid distribution conduit or hub 95. Fluid flows from the upstanding fluid distribution conduit or hub 95 into the spray arm 103 through the openings 104 aligned with the spray arm 103.

Thus, with the motor 25 operating in a first direction to drive the pump shaft 74 and recirculation pump impeller 73 in a clockwise direction, as viewed in FIG. 2, the first fluid flow path is established and a high pressure recirculation of fluid to the washing chamber 20 is effected. In its first direction of rotation the drain pump impeller 75 is operable for maintaining a generally constant fluid pressure in the drain line to prevent flow of fluid from the washing chamber 20 while preventing backflow of fluid from the drain line into the sump 63. In the opposite direction of rotation the recirculation pump impeller 73 is still operable for effecting fluid flow into the fluid distribution conduit or hub 95 at a reduced rate, but the drain pump impeller 75 becomes operable for effecting a substantial increase in pumping pressure at the drain pump outlet 119 to establish the second fluid flow path and effect a relatively rapid draining of fluid from the washing chamber 20.

Shown in FIG. 3 is a combination timer cam chart and electrical schematic circuit for a particular dishwasher embodiment. The seven increments shown on the timer cam chart between increments 2–8 constitute a rinse and hold portion of the cycle which the operator may select to rinse less than a full load while accumulating a full load of dishes. A typical cycle of sequential rinse and wash operations begins at interval 10 on the timer cam chart. When the door switch 123 is closed a circuit is completed from L1, through conductor 125, timer contact 185, conductor 127 and the timer motor 124 to L2. As the cam chart indicates, the timer contact 185 is closed throughout the cycle so that the timer motor 124 is continuously energized. At the start of the cycle a drain operation is initiated through a circuit extending from L1 through door switch 123, conductor 125, timer contact 185, conductor 127, timer contact 181, through conductor 126 to timer contact 187, through conductor 129 to the drive motor drain winding 130 through centrifugal switch 131 to the main winding 132 which is connected to contact 181 through conductor 133. The circuit to L2 is completed from the centrifugal switch 131 through the thermal protector 134. When the drive motor 25 attains sufficient speed in the counterclockwise drain direction the centrifugal switch 131 will open and only the main winding 132 will remain in the circuit between L1 and L2.

After the initial drain operation has been completed the dishwasher tub 10 is filled with fluid to a first predetermined level. The fill is accomplished under so-called static conditions or prior to operation of the pump for recirculation. As previously discussed, a float switch mechanism is provided, as shown in FIGS. 1, 2 and 4, which is designed to terminate operation of the fill valve 33 at a particular fluid level in the tub 10. The float 42 will rise with the fluid level as fluid enters the tub 10 and when a fluid level correlating to a predetermined quantity of fluid has been detected will open the fill valve 33 circuit. In a particular embodiment the float 42 is designed to open the circuit to the fill valve 33 at 1-17/64 + or −3/64 inches of fluid measured at the base of the float 42. In FIG. 1 this level of fluid is indicated by the fluid line 135.

In increment 11 a circuit is completed from L1 through the door switch 123, conductor 125, timer contact 185, conductor 127, timer contact 182, conductor 136, closed float switch 44, conductor 139, fill valve 33, and from the fill valve 33 to L2. When the quantity of fluid to achieve the first fluid level has been admitted, the rising float 42 will cause the float switch 44 to open and the dishwasher will pause until the timer motor 124 has advanced through increment 11.

At increment 12 a circuit is completed to the drive motor 25 for operation in a clockwise direction to initiate recirculation of washing fluid for a first rinsing or prewash operation. When the pump is recirculating the fluid through the washing chamber 20 the dishwashing apparatus is in the so-called dynamic or fluid moving condition. The circuit extends from L1, through door switch 123, conductor 125, timer contact 185, conductor 127, timer contact 181, conductor 126, timer contact 186, conductor 140 to the drive motor wash winding 141, through centrifugal switch 131 to the main drive motor winding 132, conductor 133 to timer contact 181. The circuit to L2 is completed from the centrifugal switch 131 through the thermal protector 134. Detergent will be added to this first period of recirculation because the detergent cup (not shown) is designed with one normally open portion so that any recirculation will wash the detergent out of the open portion and into the washing chamber 20. Due to the presence of detergent during this first rinse a prewashing of the dishes will be effected. However, if the operator elects to fill only the closed portion of the detergent cup for delayed dispensing, just a rinsing operation will be effected.

Upon completion of the first rinsing or prewash operation the drive motor 25 is again reversed to provide a drain operation identical to the initial drain. The dishwasher fill, rinse and drain operations are the same through two short rinse periods up to increment 22. During increment 22 a normal fill is completed to the 1-17/64 + or −3/64 level at fluid line 135 and the timer motor 124 advances to increment 23. At the beginning of increment 23 the drive motor 25 is energized to drive the pump for recirculation in a long wash period which extends through increment 30 with detergent added in increment 24. When the pump is started for dynamic operation in increment 23 a quantity of fluid will be displaced in the various hoses, wash arms and in the air. Consequently, the fluid level at the base of the float 42 will be sufficiently lower than when in the static condition prior to pump operation to effect resetting of switch 44 to the closed posture. Also, during this long period of wash, the combination of food soil, softened water or fluid, detergent and the extended period of recirculation tends to cause a certain amount of foaming and sudsing which may in turn cause pump starvation or cavitation. It has been found that adding an additional predetermined quantity of fluid, approximately 1.5 quarts in a specific embodiment, will prevent pump starvation. To add this quantity of fluid, the fill valve 33 is reenergized at the beginning of increment 23 for 9–15 seconds under control of the timer 45 to allow the addition of a second quantity of fluid. Because the fluid level is lowered due to the displacement of fluid when the pump starts, the float switch 44 will be in the closed posture and when timer contact 182 is closed the fill valve 33 will be reactuated for the 9–15 second timed period. This second quantity of washing fluid would bring the fluid level in the tub to 1-27/64 + or −3/64 inches at the base of the float 42 if the drive motor 25 were stopped and the fluid allowed to settle. This fluid level is indicated by line 142 in FIG. 1. Although detergent may have been introduced in the first rinse, recirculation time was not sufficient to cause the foaming and sudsing problems as encountered in the long wash period.

During the fill valve 33 operation at increments 11, 17, 32 and 37 the fluid flow is terminated by the float switch 44 with timer contact 182 serving as a safety shut-off switch. During the 9–15 seconds of fill valve 33 operation during increment 23 the fluid flow is terminated by the timer contact 182 with the float switch 44 serving as a safety shut-off switch.

During the long wash, the detergent cup (not shown), controlled by a bimetal element 143 shown schematically in FIG. 3, is actuated to dispense detergent into the washing chamber 20. The detergent cup circuit extends from L1 through the door switch 123, conductor 125, timer contact 185, conductor 127, timer contact 184, conductor 144, detergent cup bimetal 143, conductor 133, main drive motor windings 132, through the thermal protector 134 to L2. The impedance of the drive motor main winding 132 is utilized to induce bimetal 143 heating and expansion to trip the detergent cup latch mechanism.

After the long wash period two short rinse periods are initiated. In the last rinse a rinse dispenser 145, also shown schematically in FIG. 3, is actuated to provide an injection of a wetting agent for aiding in drying of the dishes. In interval 38 a circuit is completed from L1 through the door switch 123, conductor 125, timer contact 185, conductor 127, timer contact 188, conductor 146, and through the rinse dispenser 145 to L2.

After the last rinse the dishes may be dried within the washing chamber 20. If the manual selector switch 149, shown schematically in FIG. 3, has been closed the heater 46 will be activated beginning in interval 43 and remain activated through interval 54. Beginning at interval 47 the blower motor 54 will be energized to move room temperature air over the heater 46 and through the washed dishes. The blower action will continue through interval 60 at which time the cycle will end. If the manual selector switch 149 is not closed the heater 46 will not be activated and the blower will move room temperature air through the dishes without added heat.

It has been determined that, for a particular embodiment of this invention, the nominal 1-17/64 inch water line 135 fill represents 10.7 quarts of fluid. In this embodiment 10.3 quarts, which represents the quantity of fluid in the tub 10 under static conditions on the low side of the tolerance band, is substantially the lowest fluid level at which the recirculation pump 73 will perform satisfactorily during the rinse operations. As previously stated, when detergent is added in the long wash and is combined with foods and softened water, it has been determined that an additional amount of fluid is required to insure proper recirculation pump 73 performance. This additional quantity of fluid increases the fluid level to 1-27/64 inches nominally when measured at the base of the float and represents 12.2 quarts of fluid or an additional 1.5 quarts of fluid nominally and is indicated by line 142. This additional quantity of fluid is added at the beginning of increment 23.

Thus it has been shown that the fluid control system of the instant application provides a float controlled metered fill for each wash and rinse operation. Sufficient fluid is admitted without having to provide a little more than is necessary with normal or high inlet fluid pressures in order to have sufficient fluid with low inlet fluid pressures. Furthermore, the use, in one embodiment, of a timer switch and float switch connected in series, wherein the float switch is operable to reset upon initiation of fluid recirculation, results a system in which the fill valve is controlled to provide different levels of fluid for rinsing and washing with the fill valve being operable under primary control of a float switch prior to recirculation in predetermined fills to provide a first fluid level and being operable under primary control of a timer switch after recirculation has begun in at least one other fill operation to provide a second higher fluid level. Still further, the series connection of the float switch and the timer switch provides a control in which the timer switch is a secondary or safety shut-off during the metered fill and the float switch is a secondary or safety shut-off during the additional timed fill.

The heating of washing fluid to an elevated washing temperature represents the greatest total consumption of energy in a dishwashing cycle. Providing a fluid inlet system 32 which allows only a predetermined amount of fluid to enter the tub 10 conserves thermal energy and definite quantities of fluid. The fluid inlet system 32 of the present dishwasher thus provides for the effective reduction in usage of washing fluid while achieving satisfactory pump performance throughout the cycle for proper cleansing of the dishes.

In the drawings and specification, there has been set forth a preferred embodiment of the invention and although specific terms are employed these are used in a generic and descriptive sense only and not for purposes of limitation. Changes in form and the proportion of parts as well as the substitution of equivalents are contemplated as circumstances may suggest or render expedient without departing from the spirit or scope of the invention as further defined in the following claims.

I claim:

1. A dishwashing apparatus including a washing chamber, fluid inlet means for supplying fluid to said washing chamber, means for recirculating said fluid within said washing chamber, and sequential control means for controlling said apparatus during a cycle of operations including a plurality of fluid recirculation periods, wherein the improvement comprises: fluid level detecting means for energizing and deenergizing said fluid inlet means to admit a first quantity of fluid into said washing chamber under static conditions prior to initiation of each of said fluid recirculation periods of said cycle of operations; and circuit means included in said sequential control means for reenergizing said fluid inlet means to admit an additional quantity of fluid during the initial part of at least one of said fluid recirculation periods of said same cycle of operations while said fluid is being recirculated.

2. A dishwashing apparatus as defined in claim 1 wherein said fluid level detecting means and said sequential control means each include switch means connected in series to each other and wherein said fluid level detecting switch means is operable from a first posture to a second posture at a predetermined static level of fluid in said chamber corresponding to said first quantity of fluid and is resettable from said second posture to said first posture upon initiation of operation of said means for recirculating fluid to permit said fluid inlet means to admit said additional quantity of fluid under control of said sequential control switch means.

3. In a dishwashing apparatus, the combination comprising: means defining a washing chamber; fluid inlet means for supplying fluid to said washing chamber; means for recirculating said fluid within said washing chamber; sequential control means for controlling energization of said apparatus during a cycle of operations including a plurality of fluid recirculation periods; fluid level switch means for energizing and deenergizing said fluid inlet means to admit a first metered quantity of fluid into said washing chamber under static conditions prior to energization of said recirculating means for initiation of each of said fluid recirculation periods of said cycle of operations; and switch means included in said sequential control means for initiating energization of said recirculating means and for reenergizing said fluid inlet means to admit an additional timed quantity of fluid after energization of said recirculating means for at least one of said fluid recirculation periods of said same cycle of operations while said fluid is being recirculated.

4. A dishwashing apparatus including a washing chamber having a bottom wall defining a sump, fluid inlet means for supplying fluid to said washing chamber for accumulation in said sump, recirculation means for recirculating fluid from said sump to said washing chamber, and sequential control means for controlling said apparatus during a cycle of operations including a plurality of fluid recirculation periods, wherein the improvement comprises: fluid level switch means operable in a first posture during preprogrammed periods of deenergization of said recirculation means preceding each of said recirculation periods for energizing said fluid inlet means and operable from said first posture to a second posture at a predetermined liquid level for deenergizing said fluid inlet means; and timer switch means included in said sequential control means for initiating energization of said recirculation means, said fluid level switch means being reset from said second posture to said first posture upon initiation of recirculation, said timer switch means further operable for reenergizing said fluid inlet means to provide an additional quantity of fluid after the start of at least one preprogrammed recirculation period of said same cycle of operations while said fluid is being recirculated.

5. A dishwashing apparatus as defined in claim 4 where said fluid level switch means and said timer switch means are connected in series with said fluid inlet means whereby said timer switch means is a safety shut-off during filling to said predetermined liquid level and said fluid level switch means is a safety shut-off during the filling with said additional quantity of fluid.

6. In a dishwashing apparatus, the combination comprising: means defining a washing chamber and including a bottom wall defining a sump; fluid inlet means including valve means for supplying fluid to said washing chamber for accumulation in said sump; recirculation means for recirculating said fluid from said sump to said washing chamber; sequential control means including circuit opening and closing means for controlling said apparatus during a cycle of operations including a plurality of fluid recirculation periods for rinsing and washing; fluid inlet control means including level detecting means having switch means responsive to a changing fluid level for energizing and deenergizing said valve means to provide a primary metered fluid fill in said washing chamber under static conditions prior to initiation of each of said fluid recirculation periods of said cycle of operations; and timer switch means included in said sequential control means for reenergizing said valve means to admit a secondary timed fluid fill at the beginning of at least one predetermined fluid recirculation period of said same cycle of operations while said fluid is being recirculated, said level detecting switch means and said timer switch means being cooperatively associated and connected to said valve means to operate as secondary shut-off control of one for the other whereby said timer switch means is operable as a secondary shut-off control to prevent an overfill during said primary fluid fill and said level detecting switch means is operable as a secondary shut-off control to prevent an overfill during said secondary fluid fill.

7. A dishwashing apparatus as defined in claim 6 wherein said level detecting means includes float means disposed within said washing chamber and communicating with said level detecting switch means to move said level detecting switch means responsive to said changing fluid level with said level detecting switch means resettable to a closed posture upon initiation of recirculation of fluid to provide a circuit path to said valve means during said secondary timed fluid fill.

8. An apparatus for rinsing and washing dishes, the combination comprising: means defining a washing chamber and including a bottom wall defining a sump; fluid inlet means including valve means for supplying fluid to said washing chamber for accumulation in said sump; pump means communicating with said sump and operable for effecting a recirculation of washing fluid from said sump to said washing chamber; sequential control means for controlling said apparatus through a cycle of operations including a series of fluid recirculation periods for rinsing and washing said dishes; fluid level switch means operable in a first posture during preprogrammed periods of deenergization of said pump means preceding each of said fluid recirculation periods for energizing said fluid inlet means during a primary fill period and operable from said first posture to a second posture at a predetermined liquid level for deenergizing said inlet means; and timer switch means included in said sequential control means for initiating energization of said pump means, said fluid level switch means being reset from said second posture to said first posture upon initiation of recirculation, said timer switch means being further operable for reenergizing said fluid inlet means during a secondary fill period to admit an additional quantity of fluid during the initial part of at least one preprogrammed recirculation period of said same cycle of operations while said fluid is being recirculated, said fluid level switch means and said timer switch means being connected in a series circuit with said timer switch means being preprogrammed for operation to a closed position for a predetermined time period during said primary and secondary fill periods whereby said timer switch means is operable as a secondary shut-off control of said fluid inlet means during the primary fill period and whereby said fluid level switch means is operable as a secondary shut-off of said fluid inlet means during the secondary fill period.

* * * * *